United States Patent [19]

Pacione

[11] Patent Number: 4,856,835

[45] Date of Patent: Aug. 15, 1989

[54] TOOL FOR PICKING UP LITTER

[76] Inventor: Albert J. Pacione, 656 Elm St., Englewood, Fla. 34223

[21] Appl. No.: 102,167

[22] Filed: Sep. 29, 1987

[51] Int. Cl.[4] ..... B08B 1/00

[52] U.S. Cl. ..... 294/61; 15/105; 15/119 A

[58] Field of Search ..... 15/105, 116 A, 119 A; 294/50, 61

[56] References Cited

U.S. PATENT DOCUMENTS 2,695,188 11/1954 Klausman et al. ..... 294/61

4,333,198 6/1982 Vosbikian ..... 15/119 A

*Primary Examiner*—Edward L. Roberts

*Attorney, Agent, or Firm*—Sughrue, Mion, Zinn, Macpeak, and Seas

[57] ABSTRACT

An attachment is disclosed for a squeeze mop of the type having a mop handle, a water-like absorbent member or sponge at one end of the handle, and a mechanism for squeezing the water absorbent member so as to release the water contained therein. In one embodiment of the invention, the attachment comprises a flat plate containing a plurality of spike members which are used in lieu of the water absorbent member. In another embodiment of the invention, the squeezing mechanism is used to either drive a plurality of spiked members in the direction of the object or to pull the spiked object away from the tool. Various squeezing mechanisms are disclosed and various means of attaching spiked members to the end of the mop handle are illustrated and discussed in detail.

3 Claims, 4 Drawing Sheets

FIG. 5
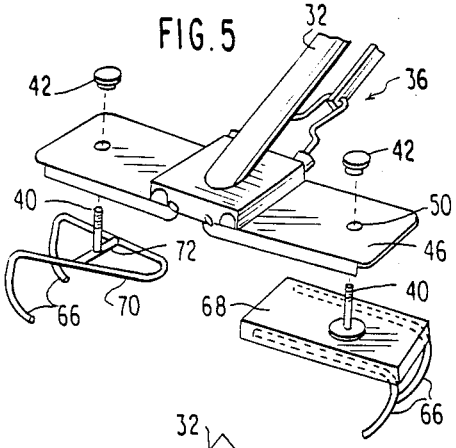
FIG. 6
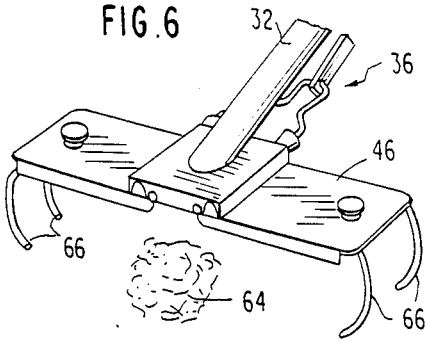
FIG. 7
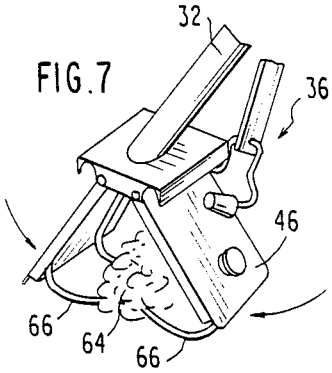
FIG. 8
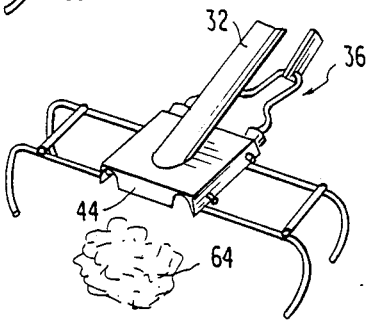
FIG. 8A
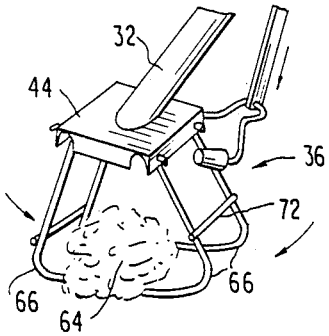
FIG. 9
FIG. 10
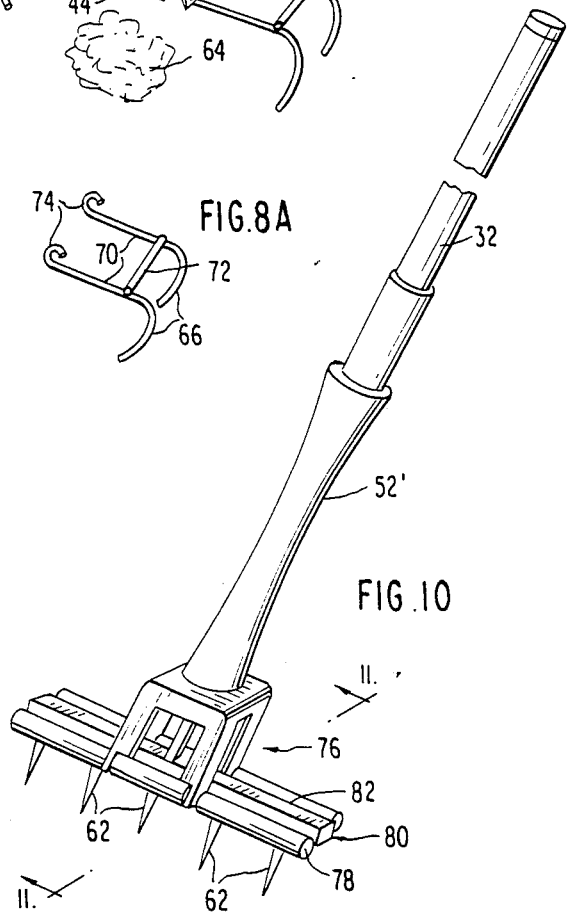

32
52'
76
82
78
80
62
64
86
88
92
52"
84
90
94
80'
100
102
104
52'''
32'

FIG. 19
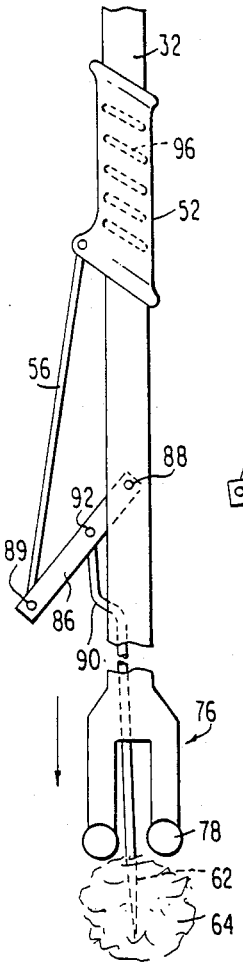
FIG. 20
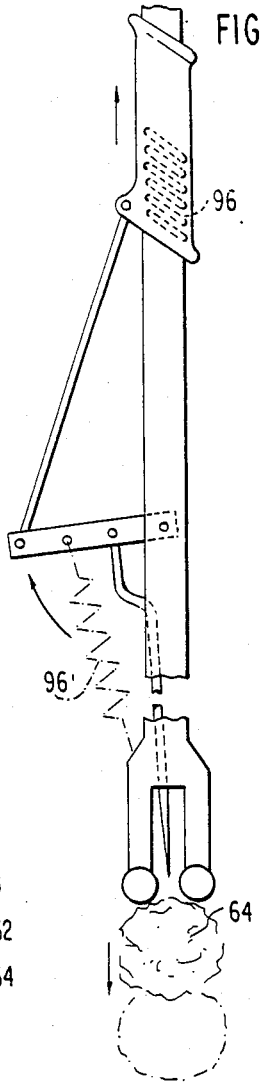
FIG. 21
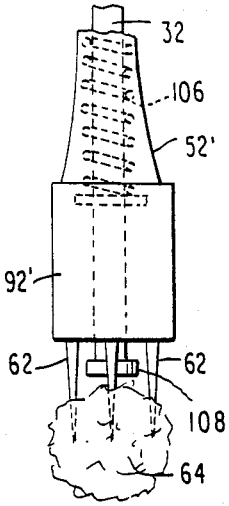
FIG. 22
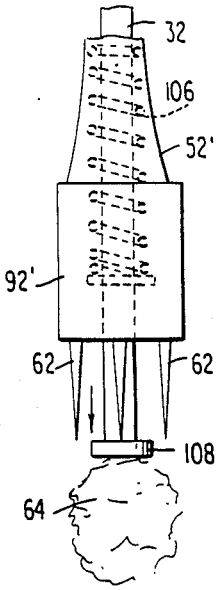
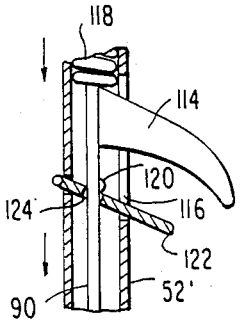
FIG. 23A
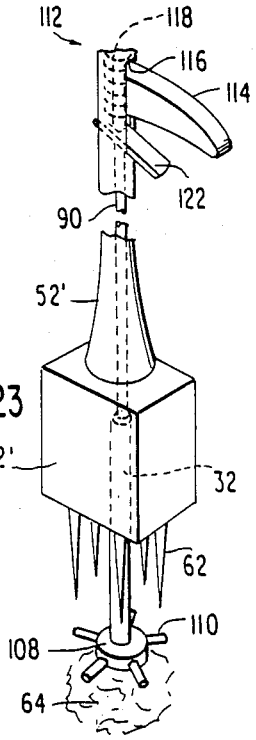
FIG. 23
FIG. 24
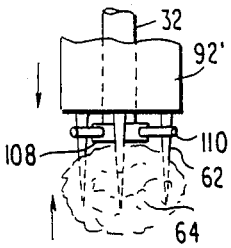
FIG. 25
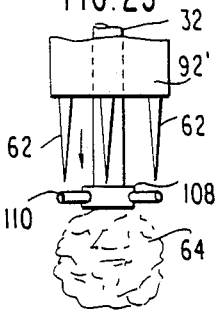

TOOL FOR PICKING UP LITTER

TECHNICAL FIELD

This invention relates to the general subject matter of self-squeezing, hand-operated, floor mops and the like and, in particular, to an attachment for such a device which enables it to be used to pick up and remove solid spearible objects, such as pine cones, wads of paper and the like.

BACKGROUND OF THE INVENTION

Everyone is familiar with the self-squeezing, hand-operated, floor mops sold in drug stores, department stores, hardware stores, and just about any place that one can buy cleaning fluid and cleaning materials. These mops are produced in great quantity by many manufacturers and thus are available at a very low price. The device basically consists of a handle with a disposable, removable, sponge-like, water absorbent material at one end and a hand-actuated, squeezing mechanism carried by the handle which can be used to squeeze the sponge and release the water contained therein. Because of their wide spread use the mechanisms are virtually trouble free and can be used just about by anyone of any age who has minimal abilities of coordination and strength. For all practical purposes, these mops appear in just about every household and just about everyone knows how to use them. Unfortunately, the self-squeezing, hand-operated mop has only one use and only one device can be attached to the operating mechanism (i.e., a cellular water absorbent sponge-like refill).

One problem facing land owners is the problem of removing debris from the land especially where that debris comes from trees. For example, pine trees drop their cones; apple and pear trees will drop their fruit, unless it is picked. According to the Florida Department of Forestry, the number of pine cones falling to the ground depends on the time of the year and type of tree. For example, some pine trees never lose their cones. Some pine trees take two years for a cone to mature; about every four to seven years is a "seed year" when many pine cones will fall to the ground. With regard to apples and pears and similar fruit, the loss of fruit is an annual event. The problem of fruit dropping in southern climates especially troublesome because it decays rapidly due to the warm temperature and yard work is exhausting in the hot sun. Of course, there is always the problem of soda cans, wads of paper, rags, and similar trash that seems to fall to the ground almost continuously.

Picking up pine cones, dropped fruit, and similar debris is not an easy and pleasant task. It is especially not easy for older persons and persons who have difficulty bending and stooping to the ground. A common device which might be used for this task is the familiar stick with the nail at one end. Such a tool, unfortunately, is not very good to pick up soft objects, such as partially decomposed fruit, or even relatively solid objects, such as pine cones. Tools especially made for such tasks are not known to exist. It is almost impossible to find such a tool at a lawn and garden shop.

Of course, the art has disclosed many devices which can be used for picking up and removing paper and trash. For the most part, these tools are nothing more than a variation of the stick with the nail at one end. The following U.S. Pat. Nos. are representative:

1,970,093
3,183,031
3,873,143

Instead of a single nail some tools have been proposed consisting of a plurality of spiked projections. The following U.S. Pat. Nos. are representative:

1,246,487
2,738,215
3,633,958

There also have been tools disclosed which resemble a claw which can be operated without having to stoop or bend to the ground. The following U.S. Pat. Nos. are representative:

2,507,655
3,105,715
3,146,015
3,194,597
3,328,066
3,446,525

Unfortunately, these tools are not known to be commercially available. In addition, a study of the tools will show that, for the most part, they are very complicated and would be undoubtedly expensive to produce. They are clearly not a tool that would be manufactured in great quantities, unless the market was known to exist. They are simply too expensive and beyond the reach of the ordinary homeowner. Thus, a problem exists for which there has not been a practical solution. With the life span of Americans increasing, and the attractiveness of gardening and home care as a rewarding use of leisure time and the ever increasing demand for well kept and maintained lawns, there is clearly a need for a easily operated, inexpensive, and readily available tool to pick up pine cones, fruit, and the like.

SUMMARY OF THE INVENTION

In accordance with the present invention, there is disclosed an attachment for a hand-operated mop of the type comprising a handle, means for carrying a sponge-like water absorbent member at one end of the handle, and means, carried by the handle, for squeezing together the sponge-like member, wherein the squeezing mechanism has an open position and a closed position wherein at least a portion of the sponge-like member is squeezed together. Specifically, the attachment is operated by the hand-operated squeezing means to impale objects at the end of the handle when the squeezing mechanism is in one of its positions and for releasing the objects when the squeezing mechanism is in its other position.

In the case of a mop having a squeezing mechanism comprising two plates hinged to one end of the handle, the impaling attachment comprises a base which is removably attached to at least one of the hinged plates (in lieu of the water absorbent sponge) and one or more spikes which are attached to the base and which project away from the hinged plates, whereby when the squeezing mechanism is operated, the two hinged plates and the spikes carried thereon are thrust upon the object to be removed.

In another embodiment wherein the mop comprises a plurality of rollers carried at the end of the mop, and wherein sponge-like, water absorbent member is pulled inwardly between the two rollers by the hand-operated, squeezing mechanism, the impaling means comprises a spike-like extension added to that end of the squeezing mechanism which pulls the sponge-like water absorbent member between the two rollers, whereby an object impaled on the spike is released by operating the squeezing mechanism so as to pull the spike between the rollers.

In still another embodiment, springs are added to a squeezing mechanism to assist the user in detaching the object once it has been impaled. In yet another embodiment, the spiked projections are added to a housing which is positioned atop the mop rollers, whereby the squeezing mechanism is used to remove the impaled object from the spiked projections. In another embodiment, a spider-like member is added to the end of the squeezing mechanism to facilitate detachment of the impaled object from the spiked projections.

Thus, by means of the attachment, a new use has been found for hand-operated, squeeze mops. More importantly, a tool is now readily available for removing pine cones, dropped fruit, and similar debris which is inexpensive, easy to use, and readily obtainable. It is ideal for use in picking up objects on lawns, at parks, along the road, at picnics, and after rock concerts and lawn parties. Numerous other advantages and features of the invention will become readily apparent from the following detailed description of the invention, the embodiments thereof, from the claims, and from the accompanying drawings.

BRIEF DESCRIPTION OF THE DRAWINGS

FIG. 5 is a partial perspective view of two additional embodiments of the attachment for the mop of FIG. 1;

FIGS. 6 and 7 are partial perspective views of the attachments of FIG. 5 prior to and after, respectively, impaling an object thereon;

FIGS. 8 and 9 are partial perspective views of another embodiment of the attachment (See FIG. 8A) of FIG. 1 prior to and after, respectively, impaling an object;

FIG. 10 is a partial perspective view of another type of self-squeezing mop with still another embodiment of the attachment that is the subject of the present invention;

FIGS. 19 and 20 are partial, side, elevational views of another type of mechanism which may be used to operate the attachment of FIGS. 11, 12 and 13;

FIGS. 21 and 22 are partial, side, elevational views of still another embodiment (See FIG. 14A) of the present invention illustrating an object impaled thereon and the manner in which it is removed;

FIG. 23 is a partial perspective view of still another embodiment of the present invention, further including a trigger mechanism (See FIG. 23A) to discharge objects impaled on the tool and;

FIGS. 24 and 25 are partial, side, elevational views of the embodiment of FIG. 23.

DETAILED DESCRIPTION

Figure 4B:
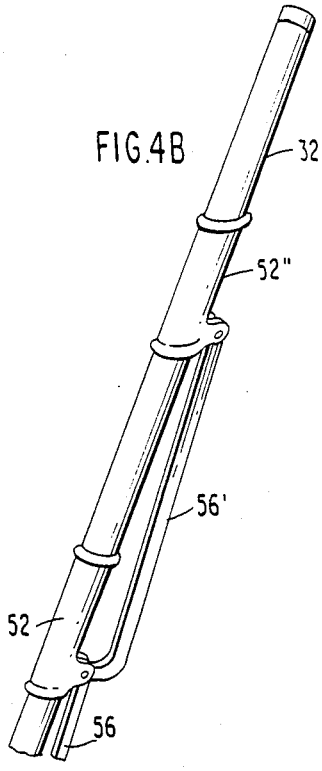
FIG. 4B is a perspective view of an alternative grip structure.

While this invention is susceptible of embodiment in many different forms, there is shown in the drawings and will herein be described in detail several preferred embodiments of the invention. It should be understood, however, that the present disclosure is to be considered an exemplification of the principles of the invention and is not intended to limit the invention to the specific embodiments illustrated.

Figure 1:
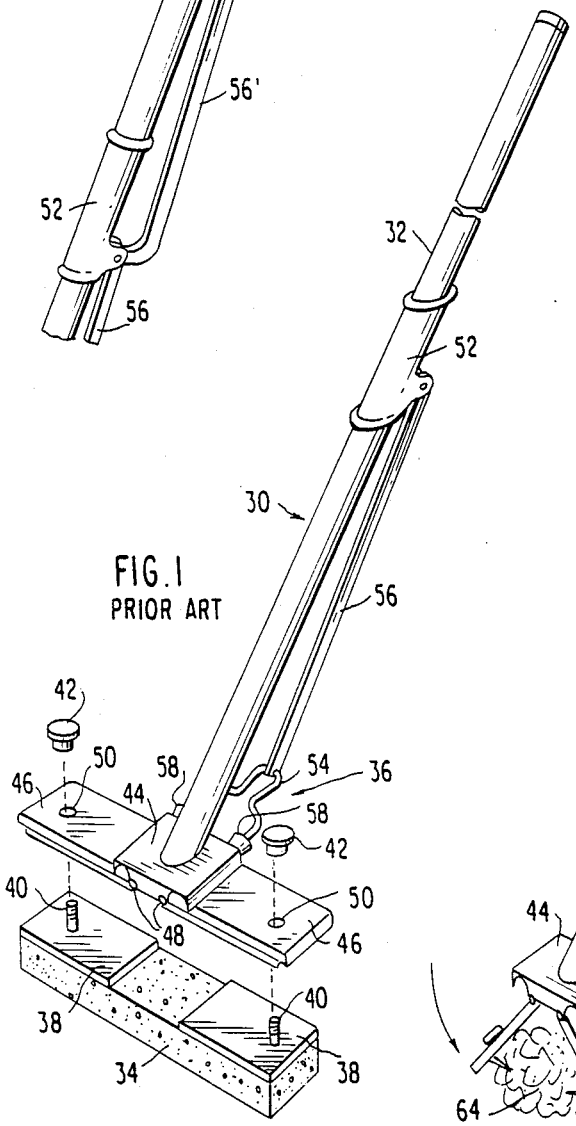
FIG.1 PRIOR ART
FIG. 1 is perspective view of one type of self-squeezing mop with which the present invention may be used.

Turning to FIG. 1, there is illustrated one design for a hand-operated squeeze mop 30 to which the teachings of the invention may be applied. Specifically, such a squeeze mop 30, inventions called a "butterfly-type" sponge mop, comprises a handle 32, a water absorbent member or sponge 34 located at one end of the handle, and means 36, operated by hand, for squeezing portions of the sponge together or squeezing the sponge against a more solid member so as to release the water contained therein. In this particular embodiment, the sponge 34 is a generally rectangular structure which is provided with two plates or members 38, at each end which have substantially more rigidity than the material of the sponge. These plate-like members 38, in this particular embodiment carry a threaded stud 40 which, by means of a suitable threaded fastener 42, may be used to attach the sponge 34 to one end of the handle 32. The squeezing mechanism 36 comprises a fixed plate 44 attached to one end of the handle 32, two flat plates 46 which are attached to the fixed plate at the end of the handle 32 by means of hinges 48. Each of the hinged plates 46 is provided with aperture 5 for receiving the stud 40 carried by the sponge 34, whereby the sponge is removably carried by the handle 32. The squeezing mechanism 36 also carries a grip 52 which is slidingly carried intermediate the ends of the handle 32, a spreader bar 54, and a link 56 which pivotally connects the spreader bar to the grip. In this particular embodiment, the spreader bar 54 is in the form of a generally Y-shaped yoke formed from a stiff wire and provided with two rollers 58 which are disposed between the fixed plate 44 at the end of the handle 32 and the two hinged plates 46 which carry the sponge 34. Thus, when the grip 52 is forced in the direction of the sponge 34, the two hinged plates 46 are forced downwardly together which forces the two opposite ends of the sponge together thereby releasing the water contained therein.

Now turning to FIG. 2, the first embodiment of the present invention will be described. Specifically, that embodiment comprises two generally rectangular plates 60 which are provided with a plurality of spiked projections 62 on one side of each plate and the threaded stud 40 on the opposite side of the plate, whereby each plate is removably connected to the hinged plates 46 of the squeezing mechanism 36, much as that illustrated in FIG. 1.

Figure 2:
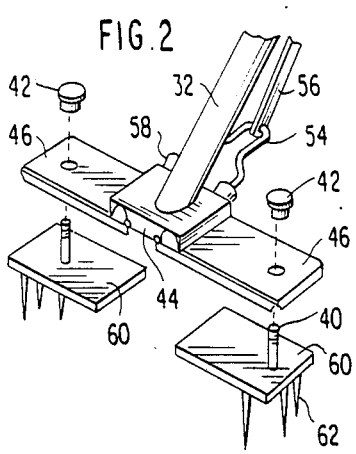
FIG. 2 is a partial, perspective, exploded view of one embodiment of an attachment which may be used with the mop of FIG. 1.
Figure 3:
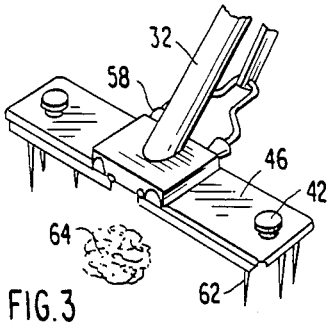
FIGS. 3 and 4A are partial perspective views of a mop of FIG. 1 with the attachment of FIG. 2 installed prior to and after, respectively, impaling an object thereon.
Figure 4A:
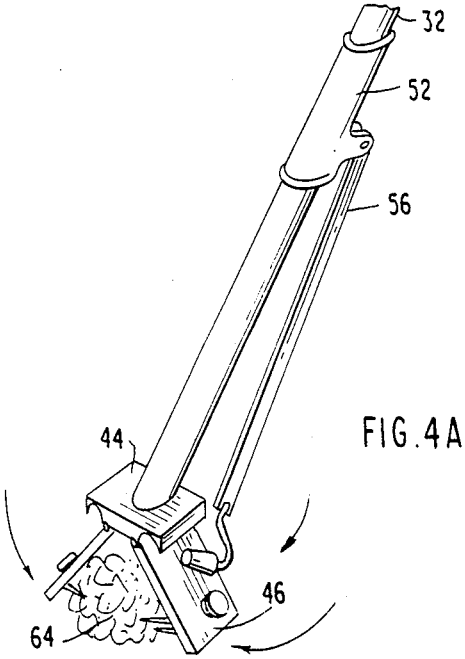

FIG. 3 illustrates the appearance of the mop mechanism of FIG. 2 when the spiked plates 60 are attached. Thus, when that end of the mop handle 32 is disposed above an object 64 to be removed and the grip 52 of the squeezing mechanism 36 is driven toward the object 64, the two hinged plates 46 will be forced together (See FIG. 4) and the projecting spikes 62 will impale the object 64, whereby it can be readily removed or transported.

Before leaving FIG. 1, it should be appreciated that when grip 52 is normally used the mop 30 is disposed over a bucket or similar container to catch the water squeezed from the sponge 34. In doing so, the person operating the mop usually does not stand erect but stands with that person's back bent downwardly. However, when the mop is converted to the apparatus of FIG. 3 (or the various other embodiments of the invention to be described), it is not necessary to bend down to use the tool. Therefore, it may be advantageous to move the grip 52 upwardly along the handle 32 by lengthening the link 56. Alternatively, a second grip 52 may be installed further upwardly along the handle 32 (See FIG. 4B) and joined by a link 56' to the primary grip 52 so that the two operate in tandem.

Turning now to FIG. 5, there is illustrated two more embodiments of the invention. Specifically, the right side of FIG. 5 illustrates an impaling means formed from two curved metal prongs 66 which are embedded in a molded plate 68. The molded plate 68 also carries a threaded stud 40 for attaching the impaling means to the hinged plates 46 of the squeezing mechanism 36.

The left side of FIG. 5 illustrates another attachment for impaling objects Specifically, that impaling device comprises a single piece of wire which has been bent so as to form a V-shaped shank 70 having two hooked prongs 66. An attachment stud 40 is attached to the shank 70 by means of a cross bar 72.

FIGS. 6 and 7 illustrate the manner in which the apparatus of FIG. 5 is used. The impaling means, whether in the form of two hooked prongs 66 and molded plates 68 on the right side of FIG. 5 or whether in the form illustrated on the left hand side of FIG. 5, when installed upon the hinged plates 46 of the squeezing mechanism will have an appearance of FIG. 6. Thus, when that end of the mop handle 32 is placed above the object 64 to be removed and the grip 52 is forced downwardly (See FIG. 7), the object 64 will be impaled on the hooked prong 66. Similarly, when the grip 52 is moved in the opposite direction the object 64 can be released.

FIGS. 8 and 8A illustrate still another embodiment of the invention. In this particular embodiment, the impaling mechanism is in the form of two wire hooks. More specifically, each hook comprises a shank 70 (See FIG. 8A), a hooked prong 66 at one end of the shank, and a smaller hook 74 which is used to hingedly connect the shank to the fixed plate 44 at the end of the mop handle 32. Each shank 70 held in a spaced apart relationship by means of a cross 72. Thus, when the impaling mechanism is install the mop handle 32 and the object 64 to be removed located below that end of the mop handle 32 and the grip of the squeezing mechanism is forced downwardly, the object 64 will be impaled on the ends of the prong 66, as shown in FIG. 9.

FIGS. 10, 11, 12, and 13 illustrate yet another embodiment of the invention. Specifically, this embodiment makes use of a hand-operated squeeze mop somewhat different from the squeeze mop of FIG. 1. Specifically, one end of the handle 32 is provided with a castellated or fork-like structure 76 which carries a plurality of rollers 78. The sponge used with that mop is normally located atop the rollers. The squeezing mechanism includes a shaft or extension of the handle 32 which is attached to the sponge at a position between the two rollers such that when the shaft is withdrawn or pulled upwardly, the sponge is forced in the narrow gap between the rollers thereby releasing the water contained therein. Thus, the sponge would be squeezed between the rollers by holding the grip 52' and pulling the handle 32.

Figures 11, 12, 13, 14, 14A, 15, 16, 16A, 17, 18:
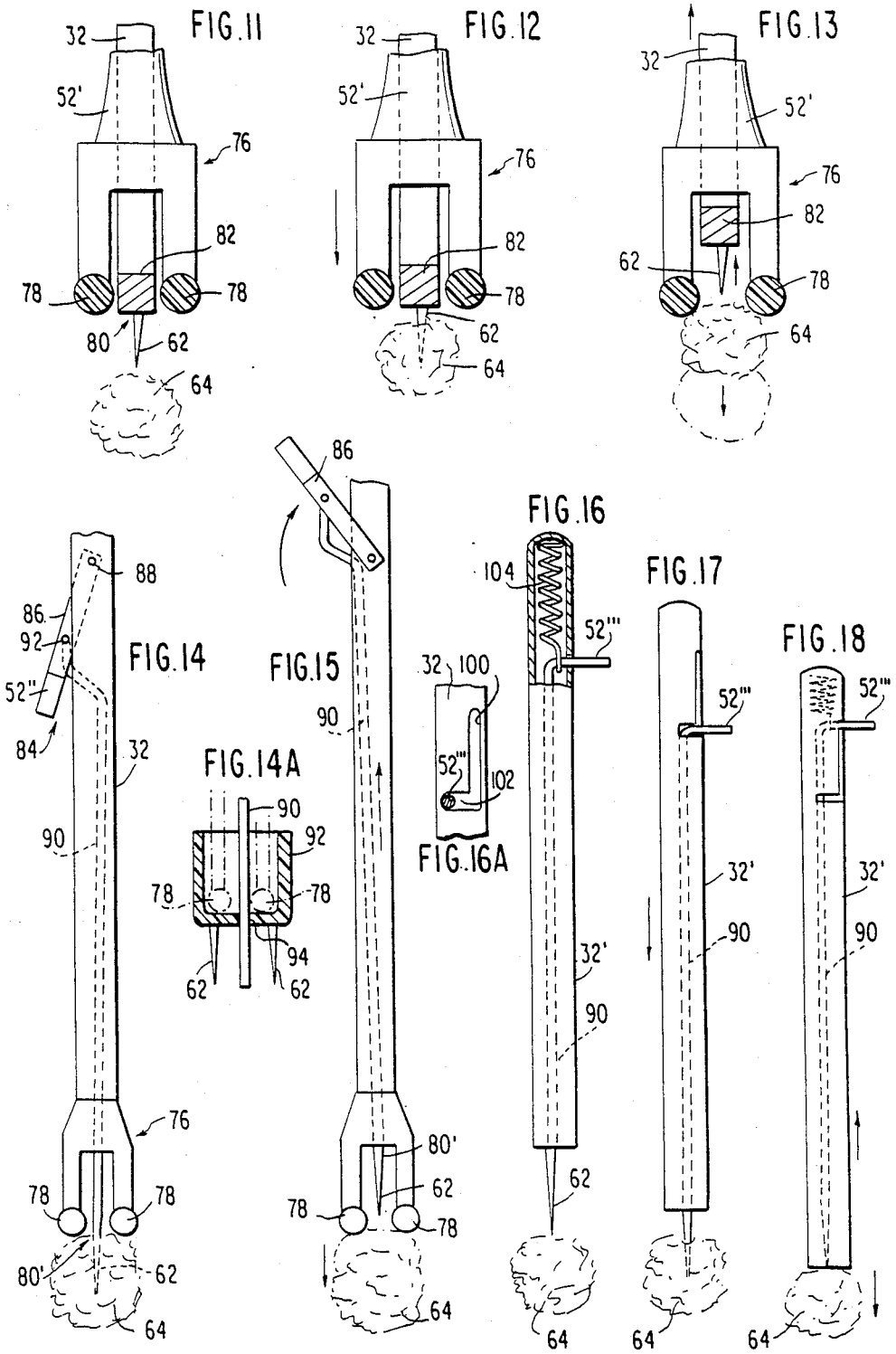
FIGS. 11, 12, and 13 are partial, cross-sectional, side, elevational views of the mop of FIG. 10, as viewed along line 11—11, prior to and after impaling an object thereon.
FIGS. 14 and 15 are partial, side, elevational views of one type of mechanism which may be used to operate the attachment of FIGS. 11, 12, and 13.
FIGS. 16, 16A, 17, and 18 are partial, crosssectional, side, elevational views of still another embodiment of the present invention.

Turning now to FIG. 11, the free end of the shaft 32 is provided with a spiked projection 80 in place of the sponge. In this particular embodiment, the spiked projection comprises a generally elongated rectangular base member 82 and a plurality of outward extending, spaced apart, generally parallel spikes 62 (See FIG. 10). The thickness of the base 82 is selected such that when the handle 32 and the grip 52' are in their normal positions, the spike 32 projects beyond the end of the rollers 78 and, when the shaft 32 and grip, 52' are pulled apart, the rollers 78 will extend beyond the end of the spike 62. Thus, the impaling means of this embodiment is operated by simply thrusting the mop handle so as to strike the object 64 (See FIG. 12), thereby impaling the object to the mop handle 32. Similarly, to release the object 64 (See FIG. 13), the handle 32 and grip 52' are pushed together, whereby the rollers 78 allow the spikes 62 to be separated from the object 64.

Before leaving the structure shown in FIGS. 11, 12, and 13, it should be apparent to those skilled in the art that the telescoping relationship of the handle 32 and the grip 52' offers many possibilities for producing a claw-like mechanism of FIGS. 2 through 9. For example, inwardly curved prongs 66 can be attached to the shafts for the rollers 78, such that by attaching to each roller shaft an arm which is linked to the lower end of the handle 32, the reciprocating movement of the handle can be converted to rotational movement of each shaft. In one specific adaption of this concept, each arm is provided with elongated apertures which overlap each other in scissor-like fashion and the lower end of the handle is provided with a forked end which carries a pin which passes through each of the two apertures.

FIGS. 14 and 15 illustrate another mechanism for operating the impaling means of FIG. 10. Specifically, in this embodiment, instead of providing a grip 52' which is telescoped about the mop handle 32, the handle is provided with a lever-like operating mechanism 84. Specifically, this mechanism comprises a lever 86 which is pivoted at one end 88 to the handle 32, a grip 52'' at the opposite end of the lever, and a rod-like shaft 90 which is pivoted 92 intermediate the ends of the lever. The gripped end 52''' of the lever is disposed towards the rollers 78. The lever 86 may be pivoted within a slot provided in the handle 32 (See FIG. 14) or may be pivoted around the handle. Similarly, the shaft 90 can be located within the interior of the handle 32 or on either side of the handle. In any case, the end of the shaft 90 which would be connected to the sponge is provided with a spiked projection 80' such that, much like the embodiment illustrated in FIGS. 10, 11, 12, and 13, the spike 62 normally extends beyond the rollers, whereby when it is desired to impale an object 64, one merely thrusts the mop handle in the direction of the object. Similarly, to remove the object 64, one would simply raise the lever 86 (See FIG. 15), whereby the rollers 78 would push the object 64 off the end spike 62.

FIG. 14A illustrates another embodiment of the invention. In this particular embodiment, a U-shaped frame 92 is fixed in position atop the rollers 78. The opposite side of the frame carries a plurality of spikes 62 (i.e., spiral nails, roofing nails). The frame 92 is also provided with an aperture 94 for receiving the free end of the shaft 90. Here the length of the shaft is extended such that when the operating lever 86 is in its raised position (See FIG. 15), the free end of the shaft would be positioned adjacent the base of the spikes 62 and when the operating lever 86 is lowered (See FIG. 14), the free end of the shaft 90 would project beyond the end of spikes 62. Thus, objects would impaled with the operating lever 86 raised and objects would be discharged with the operating lever 86 lowered (i.e., See FIG. 14). Alternatively, the frame 92 may be held on the castellated structure 76 by removing the rollers 78 (and the shafts, at the interior of each roller, which are used to mount the rollers to the structure), providing apertures in the walls of the frame and reinserting the roller shafts into the frame and structure. A plastic electrical utility box may be used to form the frame 92. Similarly, the frame 92 of FIG. 14A may be formed from a hollow, four-sided, generally rectangular box and a removable cover plate which supports the spikes 62 thereon. One advantage of a separate cover plate is that it can be readily replaced when the spikes are damaged or cannot be sharpened.

Before turning to the embodiments of FIGS. 16, 17, and 18, the operating mechanism of FIGS. 19 and 20 should be discussed. The operating mechanism of FIGS. 19 and 20 has some of the features of the operating mechanism of FIGS. 14 and 15, and FIG. 1. Specifically, there is provided a grip 52 which is slidingly disposed about the mop handle 32, a lever 86 which is pivoted at one end 88 to the mop handle, a drive shaft 90 which is pivoted 92 to the lever 86 at a point intermediate the ends of the lever, and a link 56 which is pivoted to the free end 89 of the lever and to the grip. The grip 52 may be provided with an extensible spring which biases the operating lever 86 downwardly in the direction of the roller 78. Springs 96' can also be located between the operating lever 86 and the handle 32.

Turning now to FIG. 16, 17, and 18, this embodiment of the invention is provided with a feature for forcibly removing the object from the spiked end of the operating shaft 90. As before, squeezing of the mop would be achieved by forcing one portion of the mop which is carried by the operating shaft 90 and another portion of the mop which is disposed against the handle 32. More specifically, the handle 32' is a generally hollow tube which is provided with an elongated axial slot 100 (See FIG. 16A) and a shortened slot 102 which is generally at right angles to the axial slot. The operating shaft 90 is provided with a spike 62 at one end and, at the opposite end, with a grip 52''' which is disposed generally at right angles to the main body of the shaft and which passes through the two slots on the barrel of the handle 32'. In addition, there is provided a spring 104 which is connected between the shaft 90 and the handle 32' so as to bias the spiked end of the shaft toward the inside of the handle (See FIG. 18). To use the tool, one would first move the grip 52''' in the direction of the open end of the handle 32' and into the shortened slot 102, thereby effectively overcoming the biasing spring 104. The operating shaft 90 when in this position (See FIG. 16) would have the spiked end 62 projecting from the opening at the end of the handle 32' Thus, to impale an object 64, one would simply grasp the handle and thrust it toward the object 64, whereby the object would be impaled (See FIG. 17). The object 64 could then be released simply by moving the grip 52''' in the direction of axial slot 100, whereby the spring 104 would forcibly pull the operating shaft into the interior of the handle (See FIG. 18).

FIGS. 21 and 22 illustrate an embodiment somewhat similar to that shown in FIG. 14A. More specifically, there is provided a frame 92' which carries a plurality of spiked projections 62. The frame is carried by a grip 52 which is telescoped about the operating handle 32. The operating handle 32 can be biased in one position relative to the frame 92' by means of a biasing spring 106. The lower end of the handle 32 is provided with a cap or pad 108. Thus, by withdrawing (i.e., moving upwardly) the pad 62 from the spiked ends 62, an object 64 can be impaled thereon and that object can be removed (See FIG. 22) by driving (i.e., moving downwardly) the handle 32 towards the spikes 62, whereby the pad pushes the object from the spiked ends.

FIG. 24 and 25 illustrate an embodiment wherein the pad 108 carries a plurality of radially disposed rods or arms 110. The arms 110 fit within the space between spikes 62. The arms 110 provide additional area to displace objects impaled upon spikes 62. Alternatively, the pad 108 can be generally rectangular in shape with apertures therein for the spikes 62 to pass therethrough. Alternatively, the lower end of the handle can be configured with a forked or U-shaped end and a single spike can be located at the center of the frame 92' between the uprights of the forked end. In that case, the uprights would support the pad (the pad, of course, would have a central aperture for the spike to pass therethrough).

Finally, there is the embodiment of FIG. 23 and 23A. The impaling mechanism in this embodiment is similar to that shown in FIGS. 24 and 25. To facilitate removal of objects 64 from the spikes 62, a spring loaded mechanism 112 is provided. More specifically, the operating handle carries a shaft 90 disposed at the interior of a hollow tube-like grip 52'. Projecting radially from the shaft 90 is an operating handle 114 which projects through an axial slot 116 in the wall of grip 52'. A biasing spring 118 forces the shaft 90 in the direction of the spike projections 62. Located on the exterior of the shaft 90 is a bead 120, which together with an arm or trigger 122 pivoted to the grip 52', can be used to overcome the biasing spring 118 to lock shaft 90 and the pad 108 at the base of spikes 62 (See FIG. 24). Specifically, the arm 122 contains an aperture 124 intermediate its ends which is sufficiently large to allow the operating shaft 90 and bead 120 to pass therethrough when the arm 122 is raised so as to be generally at right angles to the shaft, and which is sufficiently small such that the bead will rest upon the periphery of aperture when the arm is located at an angle to the axis of the shaft. Alternatively, the aperture can be made sufficiently small that friction will hold the shaft 90 locked in position in opposition to the biasing spring 118. Thus, to use the tool, one would hold with one hand the barrel of the grip 52' and pull the operating handle 114 with the other hand so as to pull the operating shaft 90 upwardly and separate the pad 108 from the ends of the spikes 62. This would be done while also raising the trigger lever 122 so as to allow the bead 120 to pass through the aperture 124 therein. Then by releasing the trigger lever 122, the pad 108 will be locked in its raised position (See FIG. 24). Once an object 64 is impaled at the ends of the spikes 62, it can be discharged (See FIG. 25) by simply pulling the operating handle 114 and the trigger lever 122 together. To simplify the design, the operating handle 114 can be removed and the tool held by the barrel of the grip 52'. In this embodiment the force of the object on the pad 108 would force the operating shaft 90 upwardly Without having to separately lift the handle 114 or raise the trigger 122. Thus, to impale an object 64 one would need only to hold the grip 52', with one or two hands, and thrust the spikes 62 of tool upon the object. The object would be released simply by pulling the trigger 112. Of course, the bias spring 118 need not be located above trigger; the bias spring can be located with its upper end abutting the trigger and its lower end abutting a stop carried by the shaft 90. Moreover, to bias the trigger 122 downwardly, a separate spring may be installed between the grip 52' and the top of the trigger 122.

From the foregoing, it will be observed that numerous variations and modifications may be affected without departing from the true spirit and scope of the novel concept of the invention. For example, hand-operated, squeeze mops come in many various forms and have various different squeezing mechanisms. Once it is understood that the operation of such a device involves moving one portion of a water absorbent member relative to another portion of the member or compressing a member against a fixed part of the mop handle or squeezing mechanism, then it should be clear that the squeezing mechanisms of those mops can be used to either grasp an object with one or more spikes or to discharge an impaled object by pulling or pushing the impaled projection towards or away from a fixed part of the squeezing mechanism. Similarly, although a fixed length handle has been illustrated, an adjustable length handle may be used. More importantly, the basic mechanism of FIG. 23A need not be confined to a commercially available squeeze mop; a special purpose tool can be manufactured using the principles of the invention just described. Alternatively, the mechanism of FIG. 23A may attach to the top end of a mop handle using an adapter sleeve, with the spring loaded shaft connected to the operating shaft 90 of any of the embodiments previously described Thus, it should be understood that no limitation with respect to the specific apparatus illustrated herein is intended or should be inferred. It is, of course, intended to cover by the appended claims all such modifications as fall within the scope of the claims.

I claim:

1. A tool for picking up litter comprising a hollow elongated tubular member, a pair of parallel spaced apart elongated abutment means secured to the bottom of said tubular member and extending orthogonal relative to said tubular member, an elongated operating member slidably mounted within said tubular member and having one end thereof extending outwardly of said tubular member and spike means secured to said one end of said operating member whereby upon longitudinal movement of said operating member relative to said tubular member in one direction said spike means will protrude beyond said abutment members for penetrating litter and upon movement in the opposite direction will be withdrawn past said abutment members to strip the litter from said spike means.

2. A tool as set forth in claim 1 wherein a second end of said operating member extends beyond the opposite end of the tubular member whereby the operating member and the tubular member may be gripped independently to facilitate relative movement of the tubular member and the operating member relative to each other.

3. A tool as set forth in claim 1 further comprising an operating handle pivotally mounted on said tubular member for pivotal movement about an axis transversed to a longitudinal axis of the tubular member and means connecting an operating member to said handle whereby upon pivotal movement of said handle relative to said tubular member said operating member will be moved relative to said hollow tubular member to move said spike means in opposite directions past said abutment members.

* * * * *